US009555620B2

(12) United States Patent
Kawafuji

(10) Patent No.: US 9,555,620 B2
(45) Date of Patent: Jan. 31, 2017

(54) PRINTING APPARATUS AND METHOD FOR ADJUSTING PRINTING POSITION

(71) Applicant: CANON KABUSHIKI KAISHA, Tokyo (JP)

(72) Inventor: Hiroshi Kawafuji, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/489,969

(22) Filed: Sep. 18, 2014

(65) Prior Publication Data

US 2015/0097896 A1 Apr. 9, 2015

(30) Foreign Application Priority Data

Oct. 7, 2013 (JP) ..... 2013-210371

(51) Int. Cl.

| | |
|---|---|
| ***B41J 23/00*** | (2006.01) |
| ***B41J 2/01*** | (2006.01) |
| ***B41J 2/21*** | (2006.01) |
| ***B41J 19/20*** | (2006.01) |

(52) U.S. Cl.

CPC ..... *B41J 2/01* (2013.01); *B41J 2/2135* (2013.01); *B41J 19/205* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,878,063 | A | 10/1989 | Katerberg | |
| 5,250,956 | A | 10/1993 | Haselby et al. | |
| 6,257,143 | B1 | 7/2001 | Iwasaki et al. | |
| 8,424,988 | B2 | 4/2013 | Tomida et al. | |
| 8,636,334 | B2 | 1/2014 | Nishioka et al. | |
| 2010/0309240 | A1 | 12/2010 | Tomida et al. | |
| 2011/0249062 | A1* | 10/2011 | Nakano | B41J 2/2135 347/37 |
| 2012/0001972 | A1* | 1/2012 | Nishioka | B41J 2/2135 347/12 |

(Continued)

FOREIGN PATENT DOCUMENTS

| | | | |
|---|---|---|---|
| CN | 1919604 | A | 2/2007 |
| CN | 101096146 | A | 1/2008 |

(Continued)

OTHER PUBLICATIONS

Kumagai, Toshihiro, Adusting Method of Printing Quality and Method and Device for Printing, Japan, Aug. 18, 1998.*

(Continued)

*Primary Examiner* — Matthew Luu
*Assistant Examiner* — Tracey McMillion
(74) *Attorney, Agent, or Firm* — Fitzpatrick, Cella, Harper & Scinto

(57) ABSTRACT

An adjustment value obtaining unit obtains an adjustment value for a first scanning speed before a pattern forming unit forms adjustment patterns for a second scanning speed, the pattern forming unit forms adjustment patterns by scanning with a print head at the second scanning speed with a shift amount based on an adjustment value obtained for the first scanning speed, and the adjustment value obtaining unit obtains an adjustment value for the second scanning speed based on the adjustment patterns formed by scanning with the print head at the second scanning speed.

13 Claims, 15 Drawing Sheets

(56) References Cited

U.S. PATENT DOCUMENTS

2012/0169810 A1 7/2012 Nishioka et al.

FOREIGN PATENT DOCUMENTS

| | | | | |
|---|---|---|---|---|
| CN | 101905576 | A | | 12/2010 |
| CN | 102582255 | A | | 7/2012 |
| EP | 0589718 | A1 | | 3/1994 |
| JP | 10217479 | A | * | 8/1998 |
| JP | 11-291470 | A | | 10/1999 |
| JP | 2000-37936 | A | | 2/2000 |
| JP | 2007-98838 | A | | 4/2007 |
| JP | 2009-39958 | A | | 2/2009 |

OTHER PUBLICATIONS

Japanese Office Action issued in corresponding application No. 2014-205876, dated Nov. 17, 2015—5 pages.
Chinese Office Action in corresponding Application No. 201410525008.X, dated Nov. 27, 2015 (10 pages).

* cited by examiner

PRINTING APPARATUS AND METHOD FOR ADJUSTING PRINTING POSITION

BACKGROUND OF THE INVENTION

1. Field of the Invention

The present invention relates to a printing apparatus and a method for adjusting a printing position, and more particularly to a technique of adjusting the printing position of dots printed by scanning with a print head.

2. Description of the Related Art

In a printing apparatus, for example, in a case where printing is performed by bidirectional scanning in which a print head reciprocates in two directions, dots printed by forward and backward scan may be shifted from each other. To correct such a printing position error in the printing position of dots, it is known to perform processing for adjusting printing position in the scanning with the print head (hereinafter also referred to as "registration processing"). The registration processing is also performed, for example, to correct a printing position error in printing dots with print heads that perform printing by use of different colors.

In the process of obtaining an adjustment value used for adjusting a printing position in the registration processing, a plurality of patterns (hereinafter also referred to as "adjustment patterns") are printed at different print timings. For example, in the case of bidirectional printing, with respect to a pattern printed by a forward scan, which serves as a reference pattern, a pattern is printed by a backward scan at a print timing shifted by a predetermined amount. A plurality of such a forward-backward pattern is printed with timings variously shifted by the predetermined amount. From the plurality of patterns, a pattern showing the smallest printing position error in the forward and backward scan printing is selected, and its predetermined shift amount is set as an adjustment value.

Some printing apparatuses can perform printing in a plurality of print modes that differ in a scanning speed, such as a print mode in which scanning is performed at a relatively high speed for a high print speed, a print mode in which scanning is performed at a relatively low speed for a high image quality, and the like. In a case where such printing apparatuses perform the registration processing, it is preferable to obtain an adjustment value for each scanning speed. Japanese Patent Laid-Open No. H11-291470(1999) discloses printing an adjustment pattern for each scanning speed and obtaining an adjustment value for each scanning speed based on a result obtained by reading the adjustment pattern. This allows appropriate registration processing according to the scanning speed in a case where the scanning speed varies depending on the print mode or the like.

However, a variation or a change in an ejection speed of the print head or a distance between the print head and a print medium may have an influence on the registration, and the influence level depends on the scanning speed. More specifically, the greater the scanning speed, the greater the adjustment value required to adjust a printing position which changes according to the variation or the like. In this case, the registration technique disclosed in Japanese Patent Laid-Open No. H11-291470(1999) may cause a problem that an appropriate adjustment value for eliminating a printing position error in the printing position goes beyond the range of the shift amount corresponding to the printed adjustment pattern. As a result, depending on the scanning speed, the obtained adjustment value may not be appropriate and the printing position may not be adjusted properly. To solve this problem, one may think of obtaining an appropriate adjustment value by extending the range of a shift amount as the scanning speed increases. In this case, it is required to print more adjustment patterns according to the extended range of the shift amount, and accordingly the load of the processing increases.

SUMMARY OF THE INVENTION

An object of the present invention is to provide a printing apparatus and a method for adjusting a printing position in which a printing position can be adjusted with a high degree of precision without increasing the number of patterns to be printed for a plurality of scanning speeds of a print head in registration processing.

In a first aspect of the present invention, there is provided a printing apparatus for performing printing on a print medium by scanning with a print head in which a first scanning speed of the print head and a second scanning speed that is higher than the first scanning speed are capable of being set, the apparatus comprising: a pattern forming unit configured to form a plurality of adjustment patterns for each of the first scanning speed and the second scanning speed, the plurality of adjustment patterns each including a first pattern and a second pattern and having a different shift amount corresponding to a difference in a relative printing position between the first pattern and the second pattern; and an adjustment value obtaining unit configured to obtain an adjustment value based on the plurality of adjustment patterns formed for adjusting a printing position, for each of the first scanning speed and the second scanning speed, wherein the adjustment value obtaining unit obtains an adjustment value for the first scanning speed before the pattern forming unit forms adjustment patterns for the second scanning speed; the pattern forming unit forms adjustment patterns by scanning with the print head at the second scanning speed with a shift amount based on the adjustment value obtained for the first scanning speed; and the adjustment value obtaining unit obtains an adjustment value for the second scanning speed based on the adjustment patterns formed by scanning with the print head at the second scanning speed.

In a second aspect of the present invention, there is provided a method for adjusting a printing position in a printing apparatus for performing printing on a print medium by scanning with a print head in which a first scanning speed of the print head and a second scanning speed that is higher than the first scanning speed are capable of being set, the method comprising: a pattern forming step of forming a plurality of adjustment patterns for each of the first scanning speed and the second scanning speed, the plurality of adjustment patterns each including a first pattern and a second pattern and having a different shift amount corresponding to a difference in a relative printing position between the first pattern and the second pattern; and an adjustment value obtaining step of obtaining an adjustment value based on the plurality of adjustment patterns formed for adjusting a printing position, for each of the first scanning speed and the second scanning speed, wherein the adjustment value obtaining step obtains an adjustment value for the first scanning speed before the pattern forming unit forms adjustment patterns for the second scanning speed; the pattern forming step forms adjustment patterns by scanning with the print head at the second scanning speed with a shift amount based on the adjustment value obtained for the first scanning speed; and the adjustment value obtaining step obtains an adjustment value for the second scanning speed based on the adjustment patterns formed by scanning with the print head at the second scanning speed.

In a third aspect of the present invention, there is provided a method for adjusting a printing position in a printing apparatus for performing printing on a print medium by scanning with a print head in which a plurality of different scanning speeds are capable of being set, the method comprising: a first pattern forming step of forming at least one adjustment pattern group by scanning with the print head, the at least one adjustment pattern group consisting of a plurality of adjustment patterns, the plurality of adjustment patterns each including a first pattern and a second pattern and having a different shift amount corresponding to a difference in a relative printing position between the first pattern and the second pattern; and a second pattern forming step of printing, after forming the at least one adjustment pattern group, an adjustment pattern group having the same shift amount range as that of the first and second adjustment pattern group at a scanning speed that is higher than that when the at least one adjustment pattern group is formed.

In a fourth aspect of the present invention, there is provided a printing apparatus for performing printing on a print medium by scanning with a print head in which a first scanning speed of the print head and a second scanning speed that is higher than the first scanning speed are capable of being set, the apparatus comprising: a pattern forming unit configured to form a plurality of adjustment patterns for each of the first scanning speed and the second scanning speed, the plurality of adjustment patterns each including a first pattern and a second pattern and having a different shift amount which is a difference in a relative printing position between the first pattern and the second pattern; a reading unit configured to read the plurality of adjustment patterns; an adjustment value obtaining unit configured to obtain an adjustment value based on a reading result of the plurality of adjustment patterns formed for adjusting a printing position, for each of the first scanning speed and the second scanning speed, wherein the reading unit reads the plurality of adjustment patterns for the first scanning speed before the pattern forming unit forms adjustment patterns for the second scanning speed; the pattern forming unit forms adjustment patterns by scanning with the print head at the second scanning speed with a shift amount based on the reading result of the plurality of adjustment patterns for the first scanning speed.

According to the above configuration, it is possible to adjust a printing position with a high degree of precision without increasing the number of patterns to be printed for a plurality of scanning speeds of a print head in registration processing.

Further features of the present invention will become apparent from the following description of exemplary embodiments (with reference to the attached drawings).

DESCRIPTION OF THE EMBODIMENTS

Embodiments of the present invention will be described with reference to the attached drawings.

Figure 1:
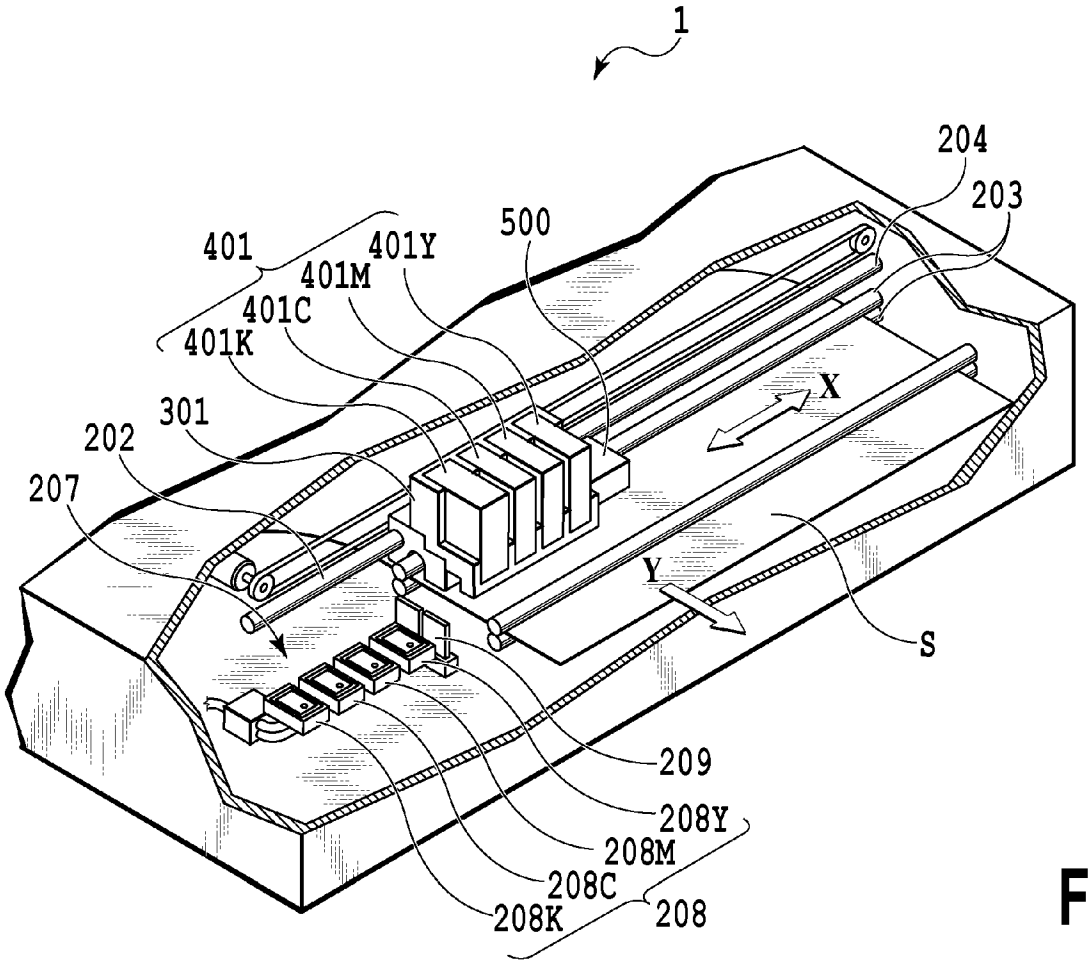
FIG. 1 is a perspective view showing an outer structure of an inkjet printing apparatus according to one embodiment of the present invention.

FIG. 1 is a perspective view showing an outer structure of an inkjet printing apparatus according to one embodiment of the present invention. In an inkjet printing apparatus 1 of the present embodiment, a print head 301 for ejecting ink is mounted on a carriage 202, and printing is performed by reciprocating the carriage 202 in directions indicated by an arrow X (main scanning direction). Accordingly, the print head 301 scans a print medium S and ejects ink to the print medium during the scanning, thereby performing printing. The printing apparatus 1 supplies the print medium S such as printing paper via a paper feed mechanism and conveys it in a direction indicated by an arrow Y (sub-scanning direction). By repeating the movement of the print head and the conveyance of the print medium, printing on the entire print medium can be performed.

More specifically, ink cartridges 401 are mounted on the carriage 202. In the present embodiment, four ink cartridges 401 (401K, 401C, 401M, and 401Y) respectively containing magenta (M), cyan (C), yellow (Y), and black (Bk) inks are mounted. These four ink cartridges 401 can be attached and removed individually.

As will be described later with reference to FIG. 3, the print head 301 is provided with nozzle arrays (ejection port arrays) each having nozzles arranged therein to eject ink of each color. The print head 301 of the present embodiment includes a heating resistor element provided for each nozzle, and the element generates thermal energy with a pulse voltage applied according to a print signal. The resulting heat causes ink to be ejected. In addition to the heating resistor element, a piezo element may be used as such an energy generation element used for ejecting ink. The carriage 202 having the print head 301 mounted thereon is slidably supported by a guide rail 204 and can reciprocate along the guide rail 204 by a driving mechanism (not shown) such as a motor. The print medium S is kept to be a constant distance with an ejection port surface (a surface on which ejection ports are provided) of the print head 301, and is conveyed in the sub-scanning direction (the direction indicated by the arrow Y) by a conveying roller 203.

At a home position outside the reciprocation area (outside the print area) of the carriage 202, a recovery unit 207 is provided for maintaining an ejection performance of the print head 301. The recovery unit 207 is provided with caps 208 (208K, 208C, 208M, and 208Y) capable of capping the ejection ports of the print head 301. The caps 208K, 208C, 208M, and 208Y are configured to cap nozzle arrays corresponding to the nozzle arrays for ejecting black, cyan, magenta, and yellow inks, respectively. The inside of each cap 208 is connected to a suction pump (negative pressure generation mechanism). This causes the negative pressure to be introduced to the inside of the cap 208 when the cap 208 caps the corresponding nozzle arrays of the print head 301, so that the ink can be sucked and discharged from the nozzles to the inside of the cap 208 (suction recovery operation). Further, the recovery unit 207 is provided with a wiper 209 such as a rubber blade to wipe off the ejection port surface of the print head 301. Further, a preliminary ejection may be performed to eject ink from the print head 301 to the inside of the cap 208.

Furthermore, a reflective optical sensor (hereinafter referred to as "an optical sensor") 500 is mounted on the carriage 202. The optical sensor 500 is a sensor capable of acquiring optical characteristics and can optically read an adjustment pattern printed on the print medium S in registration processing, which will be described later, and measure a print density of the adjustment pattern.

Figure 2:
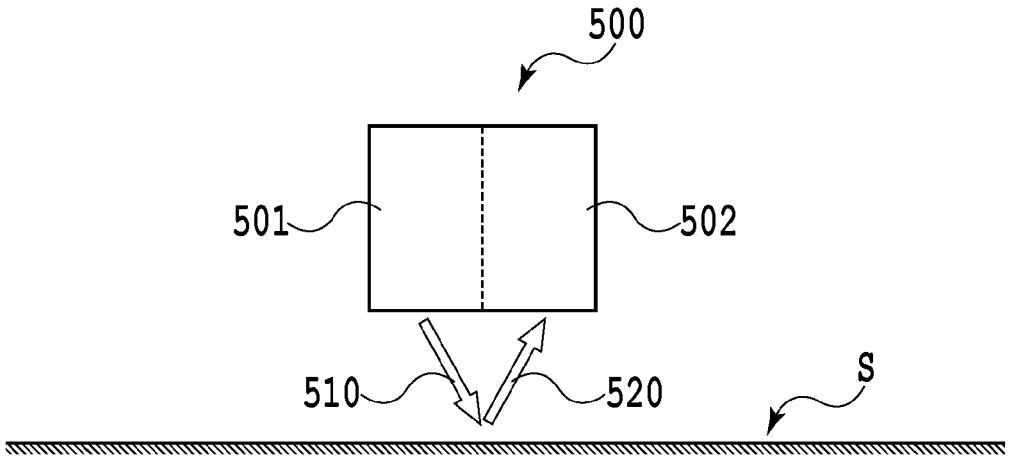
FIG. 2 is a view illustrating the process of reading by an optical sensor 500 shown in FIG. 1.

FIG. 2 is a view for explaining the process of reading by the optical sensor 500. As shown in FIG. 2, the optical sensor 500 includes a light emitting part 501 achieved by an LED or the like and a light receiving part 502 achieved by a photodiode or the like. Emitted light 510 from the light emitting part 501 is reflected on the print medium S, and reflected light 520 enters the light receiving part 502. The light receiving part 502 converts the reflected light 520 into an electric signal. When the print density of the adjustment pattern is measured, the conveyance of the print medium S in the sub-scanning direction and the movement of the carriage 202 on which the optical sensor 500 is mounted in the main scanning direction are alternately performed. Accordingly, the optical sensor 500 reads an adjustment pattern printed on the print medium and detects the density as an optical reflectivity.

Figure 3:
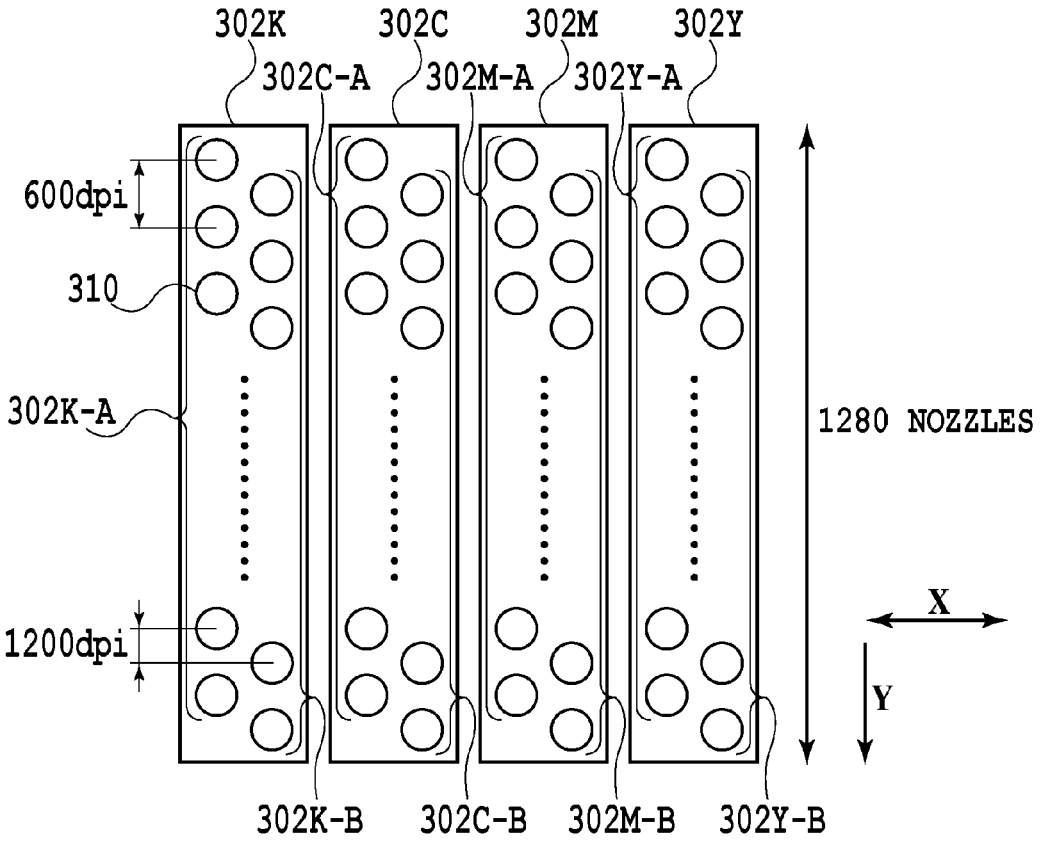
FIG. 3 is a front view illustrating nozzle arrays of ink of each color in a print head 301 shown in FIG. 1.

FIG. 3 is a front view illustrating nozzle arrays for each ink color in the print head 301 shown in FIG. 1. As shown in FIG. 3, the print head 301 is provided with nozzle arrays 302K, 302C, 302M, and 302Y for the respective ink colors. The nozzle array for each ink color consists of two nozzle arrays (302K-A, 302K-B, 302C-A, 302C-B, 302M-A, 302M-B, 302Y-A, and 302Y-B). In each of the two nozzle arrays, 640 nozzles are arranged with intervals corresponding to 600 dpi (dots per inch), and the two nozzle arrays are staggered with respect to one another by half an arrangement pitch of the nozzle array in the sub-scanning direction. Accordingly, the nozzle arrays 302K, 302C, 302M, and 302Y for the respective ink colors have 1280 nozzles arranged with intervals corresponding to 1200 dpi. This allows the print head 301 to print with a resolution of 1200 dpi in the sub-scanning direction.

The printing apparatus of the present embodiment as described above can perform printing in a plurality of print modes, which include a print mode in which scanning is performed at a relatively low speed (first scanning speed) for putting much value on a high quality printing and a print mode in which scanning is performed at a scanning speed that is higher than the first scanning speed (second scanning speed) for putting much value on a high speed printing. In printing position adjustment processing, which will be described later, printing position adjustment is performed for each scanning speed.

Figure 4:
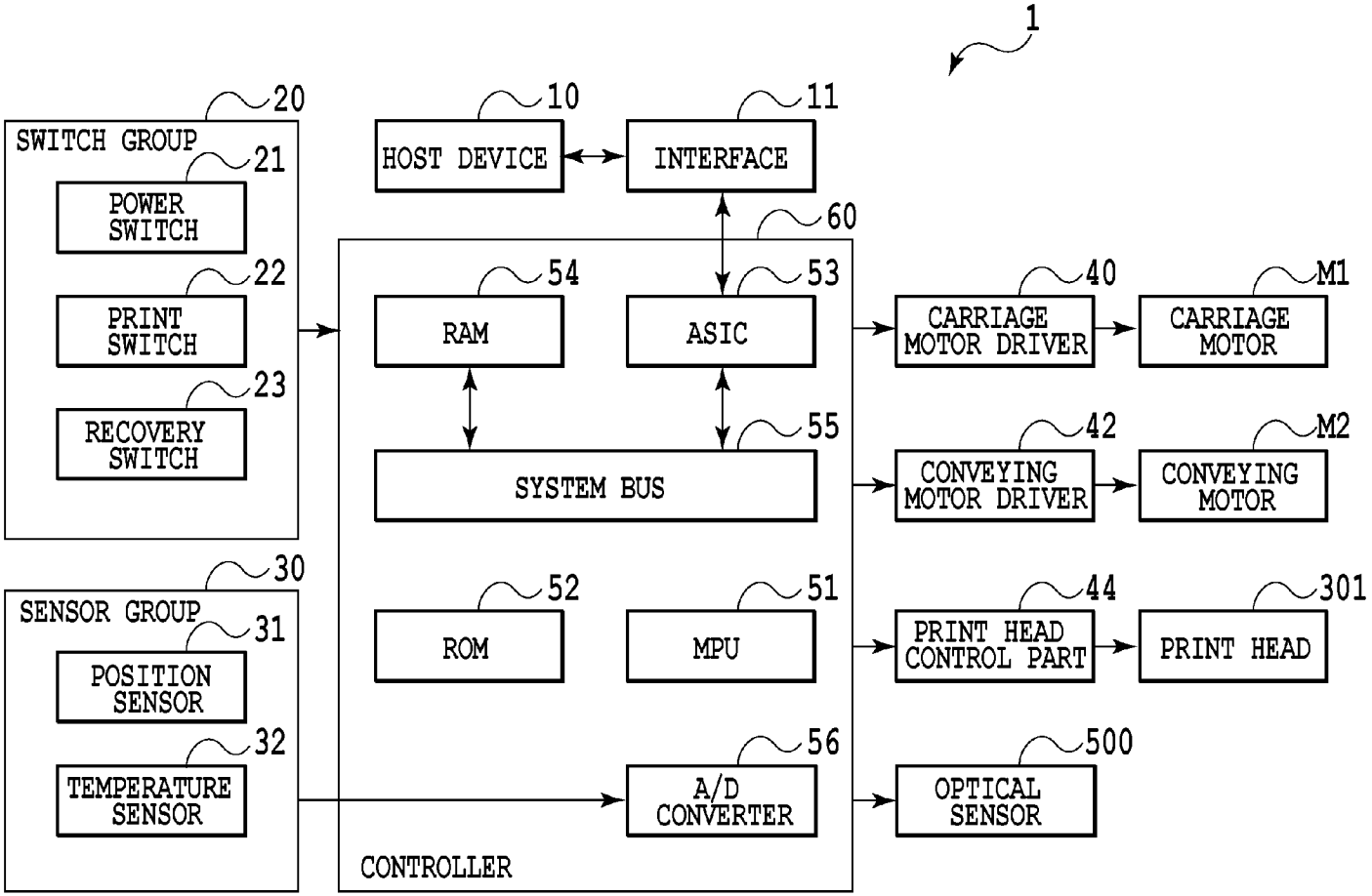
FIG. 4 is a block diagram showing the configuration of mainly data processing and control of the printing apparatus shown in FIG. 1.

FIG. 4 is a block diagram showing the configuration of mainly data processing and control of the printing apparatus shown in FIG. 1. In FIG. 4, a controller includes an MPU 51, a ROM 52, an application-specific integrated circuit (ASIC) 53, a RAM 54, a system bus 55, an A/D converter 56, and others. Here, the ROM 52 stores programs corresponding to processing and control, predetermined tables, and other fixed data as will be described later with reference to FIG. 14 and others. The ASIC 53 controls a carriage motor M1 and a conveying motor M2. The ASIC 53 also generates a control signal for controlling the print head 301. More specifically, during the scanning with the print head 301, the ASIC 53 directly accesses a storage area of the RAM 54 while transferring data for driving a printing element (ejection heater) to the print head 301. The RAM 54 is used as an expansion area for image data, a work area for program execution, or the like. The system bus 55 mutually connects the MPU 51, the ASIC 53, and the RAM 54 to transmit or receive data. The A/D converter 56 performs an A/D conversion for an analog signal inputted from a sensor group, which will be described later, and sends a digital signal after conversion to the MPU 51.

The MPU 51 has control over the operations in the printing apparatus 1. For example, in the printing position adjustment processing as will be described as an embodiment of the present invention, the MPU 51 calculates a printing position adjustment value (hereinafter also referred to simply as "an adjustment value") based on a measurement result of an adjustment pattern. The calculated adjustment value is stored in the RAM 54, for example. Further, the MPU 51 adjusts an ejection timing of ink ejected from the nozzles based on the adjustment value stored in the RAM 54 or the like and corrects a landing position (adhering position) of a dot formed on the print medium. The ejection timing of ink can be adjusted by shifting data to be assigned to a certain driving timing of an energy generation element continuously driven at a predetermined timing in a direction corresponding to an adjustment direction (e.g., the main scanning direction) by a shift amount corresponding to the adjustment value. Data can be shifted by, for example, displacing a storage address of data or by controlling a reading timing from a memory storing the data.

A switch group 20 includes a power switch 21, a print switch 22, a recovery switch 23, and others. A sensor group 30 is used for detecting conditions of the apparatus and includes a position sensor 31, a temperature sensor 32, and others.

A print head control part 44 controls the print head 301 to scan the print medium relatively for controlling the printing operation by the print head 301. The carriage motor M1 is a driving source for causing the carriage 202 to reciprocate in predetermined directions, and a carriage motor driver 40 controls driving of the carriage motor M1. The conveying motor M2 is a driving source for conveying the print medium, and a conveying motor driver 42 controls driving of the conveying motor M2. The print head 301, as described above, scans in a direction (main scanning direction) approximately crossing the conveying direction of the print medium. The optical sensor 500 detects a density of the adjustment pattern printed on the print medium as an optical reflectivity.

A host device 10 is a computer (or a reader for image reading, a digital camera, and the like) from which image data is supplied. The host device 10 and the printing apparatus 1 transmit and receive image data, commands, status signals, and the like via an interface (hereinafter referred to as "an I/F") 11.

Some embodiments of the printing position adjustment processing (hereinafter also referred to as "registration processing") in the above-described printing apparatus will be described.

First Embodiment

Figure 5:
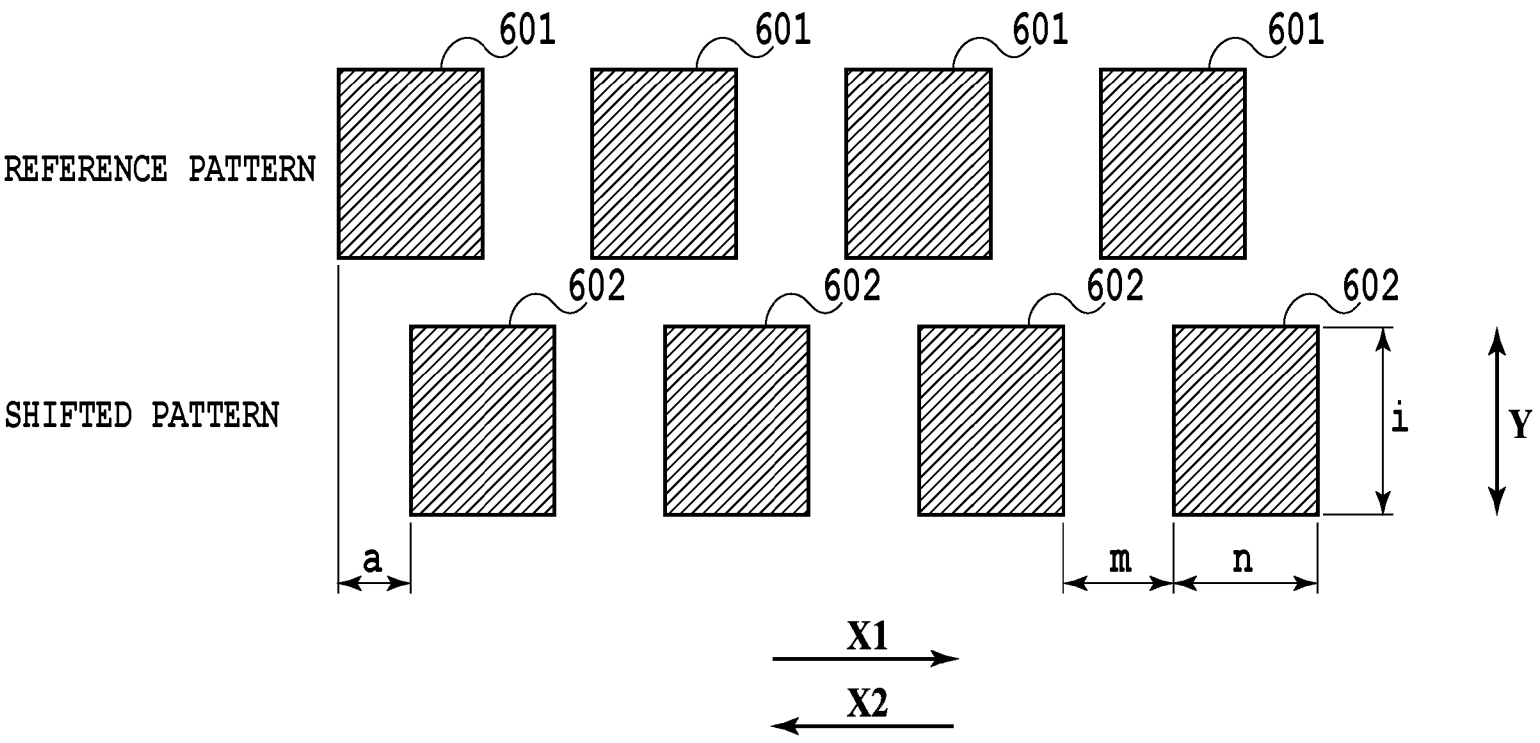
FIG. 5 is a view illustrating an adjustment pattern used in printing position adjustment processing according to a first embodiment of the present invention.

FIG. 5 is view illustrating an adjustment pattern used in printing position adjustment processing according to a first embodiment of the present invention. As shown in FIG. 5, the adjustment pattern includes reference patterns (first pattern) 601 and shifted patterns (second pattern) 602, and each of patterns is a rectangular pattern consisting of n pixels in the main scanning direction (X1 and X2 directions)×i pixels in the sub-scanning direction (Y direction). Each of the reference patterns 601 and the shifted patterns 602 is formed so that the rectangular pattern serves as a unit pattern is arranged in the main scanning direction with blank areas corresponding to m pixels. The registration processing according to the present embodiment is explained as an example of adjusting printing positions of nozzle arrays for different ink colors. The reference pattern 601 is printed by a reference nozzle array and the shifted pattern 602 is printed by a nozzle array to be adjusted. Incidentally, in the adjustment pattern that is actually printed, the reference pattern 601 and the shifted pattern 602 are printed in an area on the same position in the sub-scanning direction, while being displaced from each other by "a" pixels in the main scanning direction. That is, the reference pattern 601 and the shifted pattern 602 are printed so as to partly overlap with each other in an area on the same position in the sub-scanning direction. Incidentally, a resolution or a shift amount of the adjustment pattern may be determined according to a print resolution of the printing apparatus, and in the present embodiment, the print resolution corresponds to 1200 dpi. Note that the registration processing to which the present invention is applied is not limited to processing for printing position adjustment of nozzle arrays for different ink colors, and may relate to, for example, processing for printing position adjustment with respect to bidirectional printing. As will be apparent from the following description, the present invention can also be applied to printing position adjustment other than the printing position adjustment of nozzle arrays for different ink colors.

Figure 6:
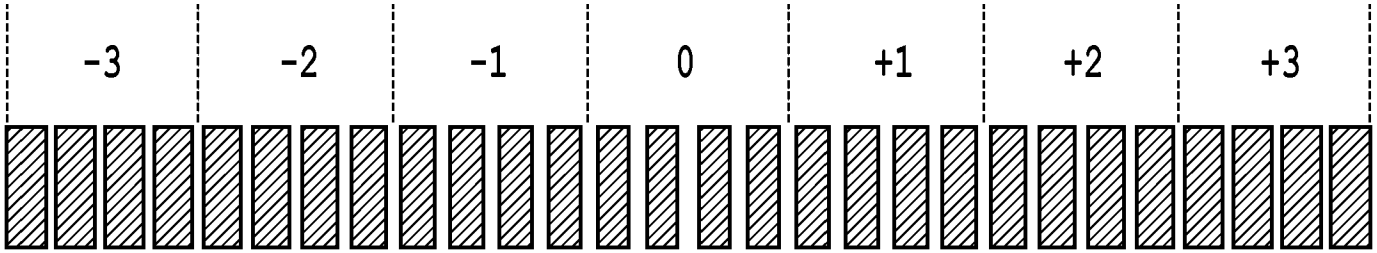
FIG. 6 is a view showing patterns printed in registration processing, obtained by printing the adjustment pattern shown in FIG. 5 for each adjustment value.

FIG. 6 is a view showing patterns printed in the registration processing, obtained by printing the adjustment pattern shown in FIG. 5 for each shift amount. As shown in FIG. 6, a shift amount corresponding to the patterns printed in the present embodiment has the range of "−3" to "+3." In the present embodiment, as will be described, the shift amount range in which the patterns are printed in the registration processing performed for each scanning speed is fixed irrespective of the scanning speed. That is, the number of adjustment patterns to be printed corresponds to the shift amount range, and accordingly, the number of adjustment patterns to be printed can be fixed even if the scanning speed varies depending on the print mode. The patterns shown in FIG. 6 vary depending on the shift amount corresponding to "a" pixels as shown in FIG. 5, and a shift amount of "−3" corresponds to, for example, an adjustment pattern printed by displacing the shifted pattern 602 from the reference pattern 601 by three pixels in the X2 direction (FIG. 5). Meanwhile, a shift amount of "+3" corresponds to an adjustment pattern printed by displacing the shifted pattern 602 from the reference pattern 601 by three pixels in the X1 direction (FIG. 5). More specifically, in the case of printing the adjustment pattern (and an image in normal printing) with a resolution of 1200 dpi at different scanning speeds, depending on the scanning speed, the above-mentioned two patterns are printed at different ejection timings so as to be displaced with each other by, for example, three pixels with a resolution of 1200 dpi according to the shift amount of "−3." In this case, it should be noted that as the scanning speed increases, the adjustment patterns are printed at ejection timings with a higher ejection frequency. Incidentally, the number indicating the shift amount does not necessarily match the number of pixels to be displaced, and a shift amount of "−3" may correspond to 6 which is the number of pixels to be displaced, for example.

Figure 7:
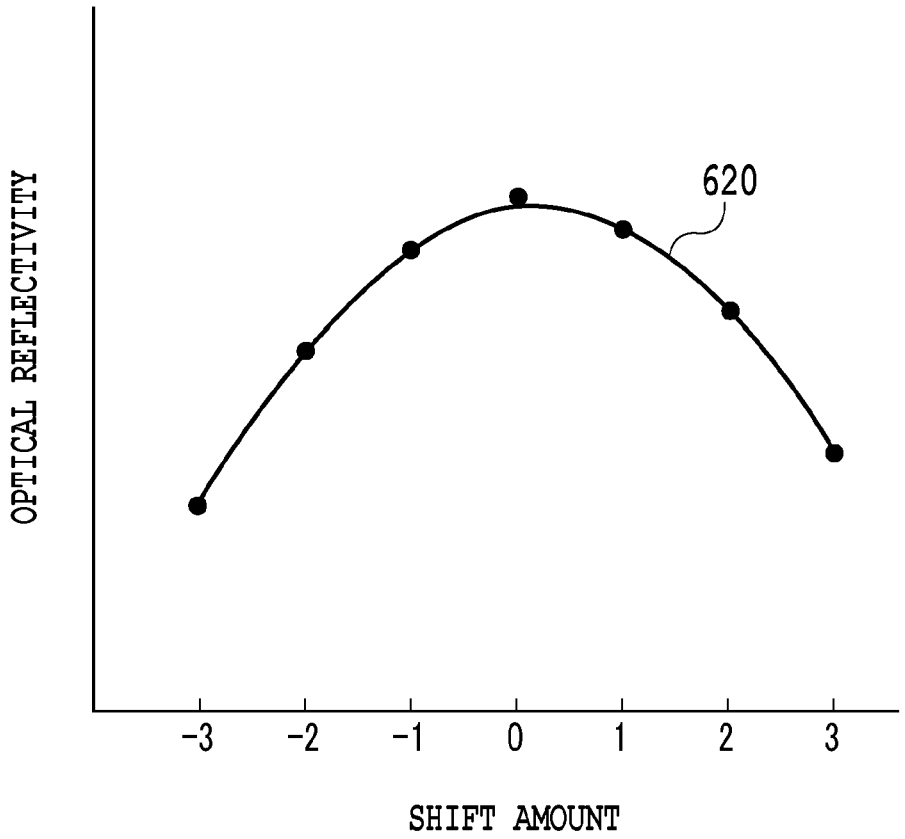
FIG. 7 is a graph showing an example of the result of reading by the optical sensor 500 the adjustment pattern for each adjustment value shown in FIG. 6.

FIG. 7 is a graph showing an example of the result of reading by the optical sensor 500 the adjustment pattern for each shift amount shown in FIG. 6, and showing measurement results of the reflectivity of each adjustment pattern. Here, the smaller the positional displacement between the reference pattern and the shifted pattern in the adjustment pattern, the higher the optical reflectivity. Accordingly, in the present embodiment, an approximate curve of the reflectivity is obtained based on the measurement results of the adjustment patterns corresponding to seven shift amounts shown in FIG. 6 and a shift amount corresponding to the highest reflectivity is obtained. Based on the shift amount, an adjustment value used for adjusting an ejection timing is obtained. Note that the density of the adjustment pattern is inversely proportional to the reflectivity, and the smaller the positional displacement in the adjustment pattern printed on the print medium, the lower the density.

Incidentally, the number of adjustment patterns formed on a print medium and the shift amount may be determined according to the adjustment range required in view of mechanical tolerances of the apparatus or a shift unit of a printing position. That is, the number of adjustment patterns formed on a print medium and the shift amount may be determined in accordance with the accuracy of the printing position adjustment processing. Further, a print area of the adjustment pattern may be determined according to the size of a detection area of the optical sensor 500, the width of a printable area in one scan, the size of a printable area on a print medium with respect to the adjustment pattern group, and the like. Further, nozzle arrays used for printing the reference pattern and the shifted pattern are determined according to the combination of an ink color, a scanning direction, and the like of the nozzle arrays to be adjusted. In the adjustment in a forward scan, a reference nozzle array (for example, 302K-A) is determined to form a reference pattern, and then a shifted pattern is formed by using another nozzle array (for example, 302C-A). The adjustment in a backward scan can be performed in the same manner.

Next, a description will be given of an influence of a difference in the scanning speed of the print head on a variation of a printing position.

A landing position of ink ejected from the nozzles of the print head on the print medium changes due to various factors such as a distance between the print head and the print medium (a head-print medium distance), an ink ejection speed, and a scanning speed of the print head. In particular, as the scanning speed of the print head increases, a printing position error in the printing position of ink dots increases due to a variation in the ink ejection speed or a variation in the head-print medium distance.

Figure 8:
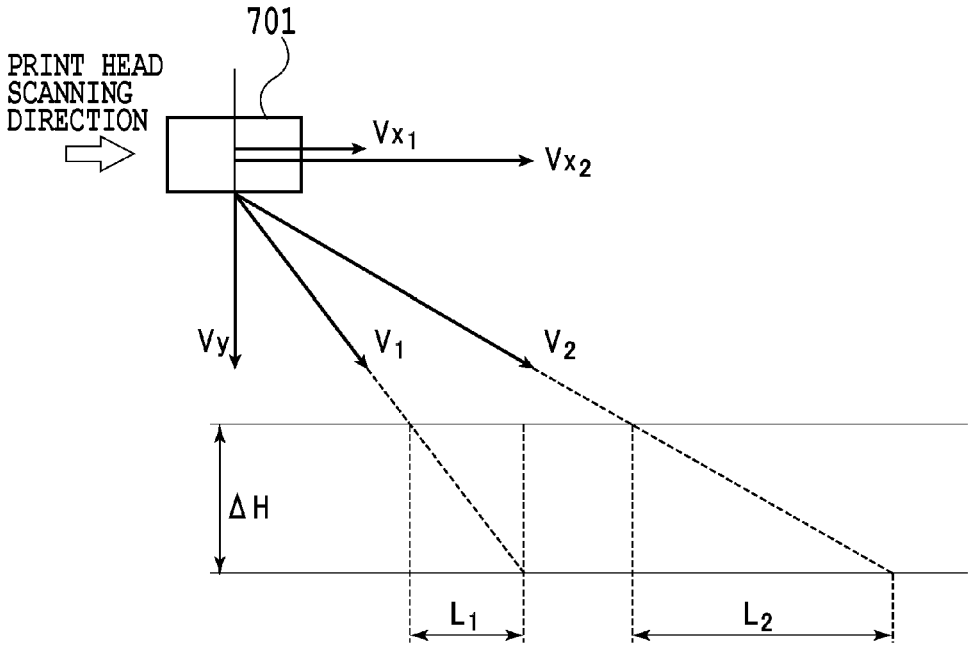
FIG. 8 is a diagram showing a printing position error in the printing position of dots for two different scanning speeds in a case where a distance between a print head and a print medium changes.

FIG. 8 is a diagram for showing a printing position error in the printing position of dots for two different scanning speeds in a case where a distance between the print head and the print medium changes. In FIG. 8, a reference sign 701 denotes a print head 701 and a reference sign Vy denotes an ink ejection speed by the print head. Further, reference signs $V_1$ and $V_2$ denote flying speeds when scanning by the print head is performed at scanning speeds $Vx_1$ and $Vx_2$ ($Vx_1<Vx_2$), respectively.

In a case where a distance between the print head and the print medium changes by ΔH, a printing position error in the printing position (landing position) of ink dots caused by a change in the distance when scanning at the scanning speed $Vx_1$ is indicated by L1, whereas a printing position error when scanning at the scanning speed $Vx_2$ is indicated by L2. As is apparent from FIG. 8, if a change amount of the head-print medium distance is the same, the printing position error in the printing position of dots increases as the print head scans at the higher scanning speed $Vx_2$.

Figure 9:
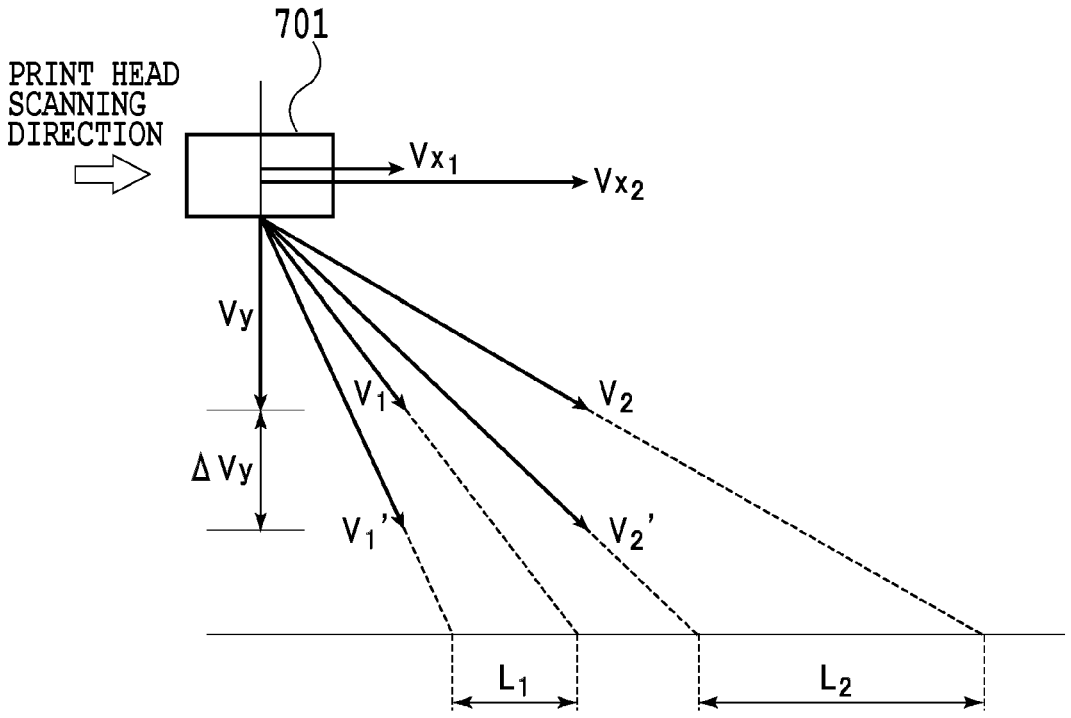
FIG. 9 is a diagram showing a printing position error in the printing position of dots for two different scanning speeds in a case where an ink ejection speed changes.

FIG. 9 is a diagram showing a printing position error in the printing position of dots for two different scanning speeds in a case where an ink ejection speed changes. In the same manner as FIG. 8, a reference sign 701 denotes a print head 701 and a reference sign Vy denotes an ink ejection speed by the print head. Further, reference signs $V_1$ and $V_2$ denote flying speeds when scanning by the print head is performed at scanning speeds $Vx_1$ and $Vx_2$ ($Vx_1<Vx_2$), respectively.

If an ink ejection speed changes by ΔV, while scanning at the scanning speeds $Vx_1$ and $Vx_2$, the flying speeds become $V_1'$ and $V_2'$, respectively, and printing position errors of the printing position of dots are indicated by L1 and L2. As is apparent from FIG. 9, if a change amount of the ink ejection speed is the same, the printing position error in the printing position of dots is larger when the print head scans at the higher scanning speed $Vx_2$.

As described above, as the scanning speed of the print head increases, the printing position error in the printing position of dots caused by changes in the head-print medium distance and the ink ejection speed increases. As a result, in the registration processing at a high scanning speed, the adjustment pattern to be printed may occasionally be inappropriate.

Figure 10:
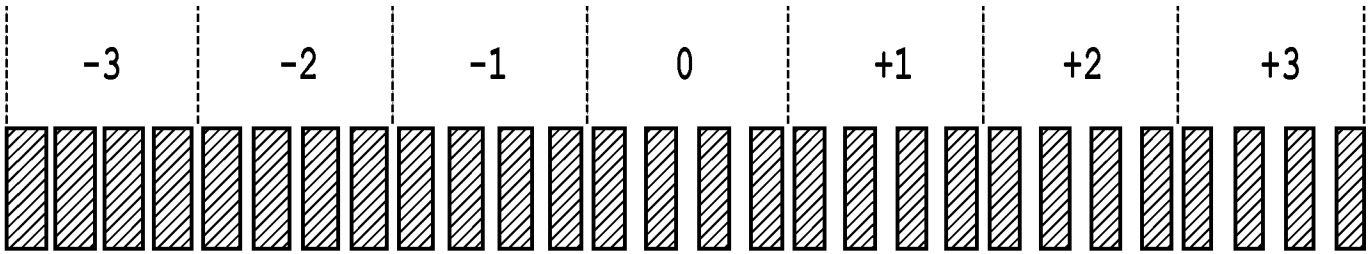
FIG. 10 is a view showing adjustment pattern groups in a case where a printing position error in the printing position of dots occurs due to a change in a distance between a print head and a print medium or an ink ejection speed.

FIG. 10 is a view showing adjustment pattern groups in a case where a printing position error in the printing position of dots occurs due to a change in the above-described head-print medium distance or ink ejection speed. Further, FIG. 11 is a graph showing measurement results of an optical reflectivity of the adjustment pattern shown in FIG. 10.

Figure 11:
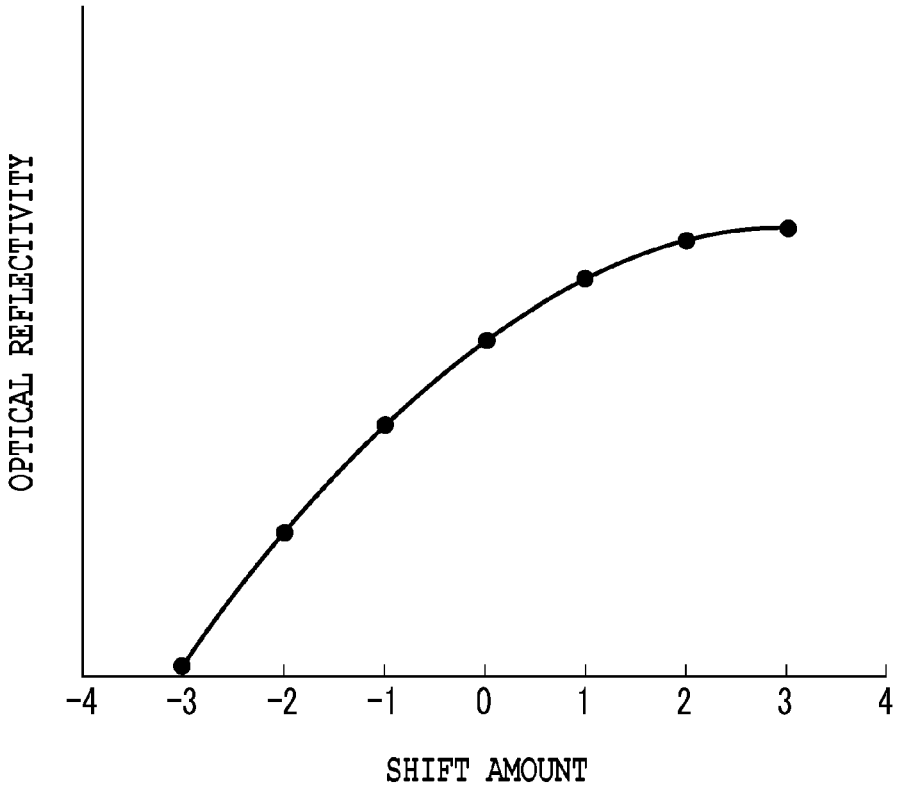
FIG. 11 is a graph showing measurement results of an optical reflectivity of the adjustment pattern shown in FIG. 10.

In the examples shown in FIGS. 10 and 11, in a shift amount within the range of "−3" to "+3, "the adjustment pattern of the shift amount of "+3" has the highest reflectivity (the lowest density). However, a displacement between the reference pattern and the shifted pattern of the adjustment pattern can also be the smallest in a shift amount within the range of "+3" or greater. In this case, if the adjustment pattern is formed in a shift amount within the range of "−3" to "+3" and an adjustment value is determined based on the measurement results of the adjustment pattern, a printing position error in the printing position existing in the printing apparatus cannot be appropriately corrected.

Figure 12:
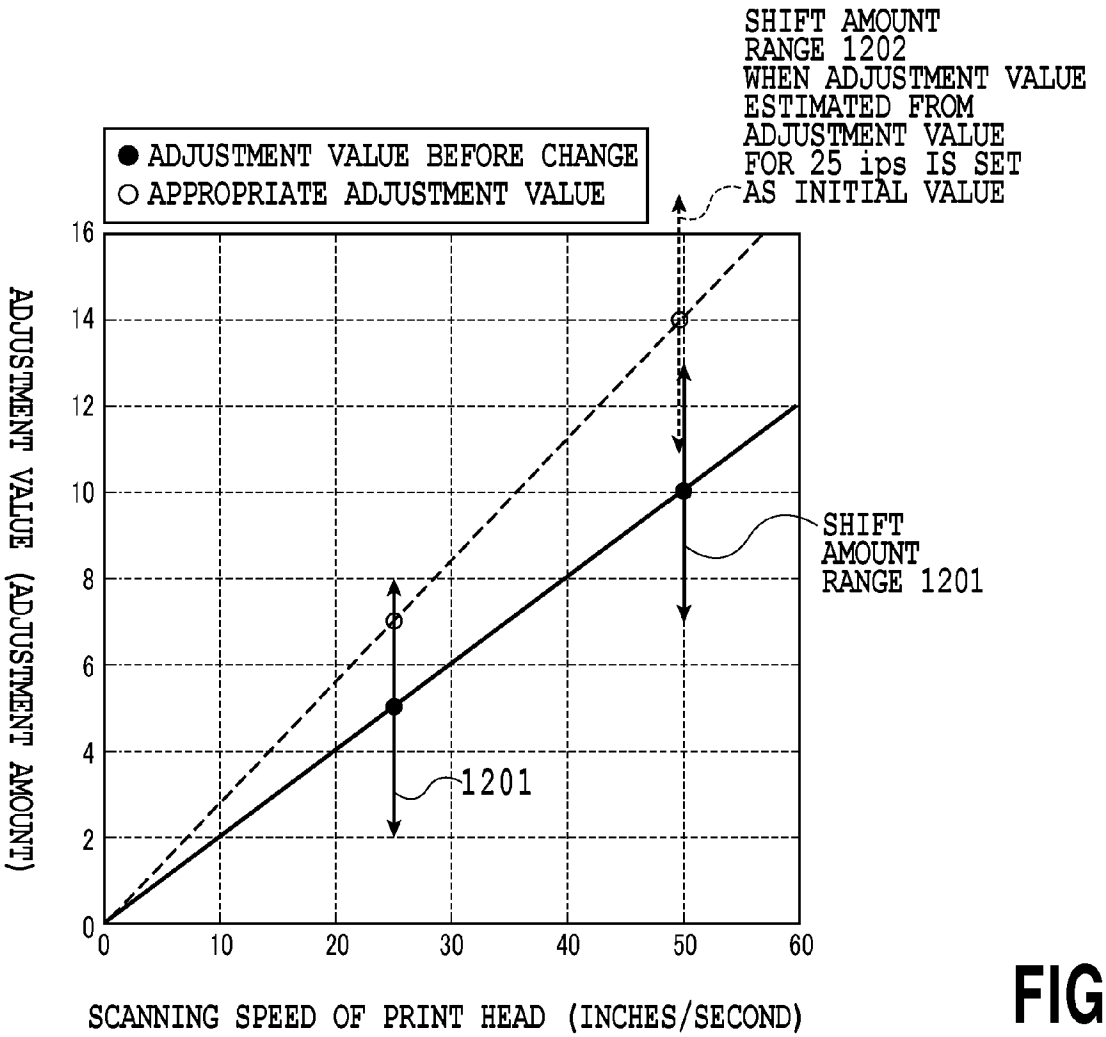
FIG. 12 is a graph illustrating settings of a shift amount range corresponding to adjustment patterns for two different scanning speeds according to the first embodiment of the present invention.

FIG. 12 is a graph illustrating settings of a shift amount range corresponding to adjustment patterns for two different scanning speeds according to the first embodiment of the present invention. More specifically, FIG. 12 shows the relationship between a scanning speed and an adjustment value (adjustment amount) required for the adjustment of a printing position. A solid line shows the relationship before a head-print medium distance, an ink ejection speed, or the like changes as described above with reference to FIGS. 8 and 9, whereas a broken line shows the relationship after the change. Note that the above-mentioned "adjustment value (adjustment amount) required" means that, in the adjustment of a printing position, when an ejection timing or the like is adjusted based on the obtained adjustment value, for example, as the scanning speed doubles, the adjustment value (adjustment amount) required also doubles even if the shift amount corresponding to the adjustment patterns shown in FIG. 6 or the like is the same, and the above-mentioned "adjustment value (adjustment amount) required" does not indicate the adjustment amount itself. Further, in each of the solid and broken straight lines showing the above relationships before and after the change in the printing position, a point on the straight lines shows that it is estimated that the adjustment value (adjustment amount) corresponding to the point can appropriately solve a printing position error in a printing position.

A discussion will be made regarding the adjustment of a printing position as shown in FIG. 12 when the relationship between the scanning speed and the adjustment value (adjustment amount) required for the adjustment of a printing position changes to the relationship shown by the broken line in a case where the head-print medium distance, the ink ejection speed, or the like changes. Before the change, a shift amount range 1201 is set for a scanning speed of 25 ips (inches per second) and a scanning speed of 50 ips. This shift amount range ("−3" to "+3") is set to a position where, for example, a median value "0" (shown by a filled circle) of the shift amount intersects with the solid line. If a state before the change becomes a state after the change shown by the broken line, in the adjustment of the printing position at a scanning speed of 25 ips, an adjustment value (shown by an open circle) that is estimated to be appropriate falls within the shift amount range. Accordingly, the adjustment pattern is formed within the shift amount range and an appropriate adjustment value (adjustment amount) can be obtained by measuring the adjustment pattern. On the other hand, in the adjustment of the printing position at a scanning speed of 50 ips, an adjustment value (shown by an open circle) that is estimated to be appropriate for the shift amount range 1201 as set before the change does not fall within the shift amount range 1201. Therefore, even if the adjustment pattern is formed within this shift amount range and measured, the printing position cannot be appropriately adjusted. In the case of a higher scanning speed, the shift amount range may be extended according to the scanning speed, but in this case, the number of adjustment patterns to be formed increases as described before.

In the present embodiment, the adjustment of the printing position at a scanning speed of 25 ips is performed before the adjustment of the printing position at a scanning speed of 50 ips. Then, based on the adjustment value (shown by the open circle on the broken line in the range 1201) obtained in the adjustment of the printing position at a scanning speed of 25 ips, an adjustment value (shown by an open circle on the broken line in a range 1202 shown by the broken line) at a scanning speed of 50 ips is estimated.

As shown by the linear relationships of the solid line and the broken line in FIG. 12, the adjustment value is proportional to the scanning speed of the print head. In the example shown in FIG. 12, the adjustment value at a scanning speed of 25 ips is 7. Thus, the adjustment value at a scanning speed of 50 ips is estimated to be 14. Note that the numbers "7" and "14" do not always express actual specific adjustment values (adjustment amounts), but indicate a value as an adjustment value at which a printing position error in the printing position can be solved at a scanning speed of 25 ips, and also mean that an adjustment value at a scanning speed of 50 ips is double the value. Next, the adjustment pattern at a scanning speed of 50 ips is formed in a manner that the estimated adjustment value is associated with a median value of the shift amount. That is, the estimated value 14 is associated with the median value "0" and seven adjustment patterns are formed within the adjustment value range 1202 ("−3" to "+3"). Accordingly, also in the adjustment of the printing position at a scanning speed of 50 ips, it is possible to obtain an adjustment value that is appropriate within the adjustment value range equal to the adjustment value range at a scanning speed of 25 ips. This allows the adjustment of the printing position to be appropriately performed without increasing the number of adjustment patterns.

Note that it is possible to print a reference pattern and a shifted pattern to start to form an adjustment pattern after estimating an adjustment value at a scanning speed of 50 ips. Alternatively, it is possible to print the reference pattern (seven reference patterns as the above, for example) at a scanning speed of 50 ips before estimating an adjustment value at a scanning speed of 50 ips or before obtaining an adjustment value at a scanning speed of 25 ips, and then after estimating an adjustment value at a scanning speed of 50 ips, the adjustment value at the estimated scanning speed of 50 ips is associated with a median value of a shift amount, and a shifted pattern is printed at a scanning speed of 50 ips to complete the adjustment pattern for the scanning speed of 50 ips.

Figure 13:
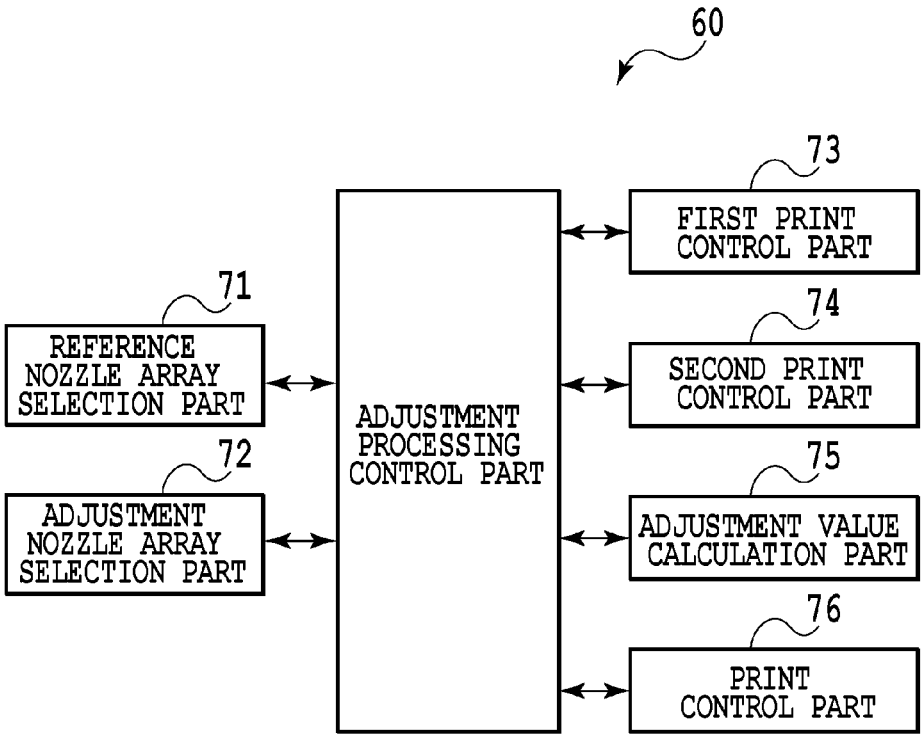
FIG. 13 is a block diagram showing functions of control and processing realized by a controller 60 shown in FIG. 4.

FIG. 13 is a block diagram showing functions of control and processing realized by the controller 60 shown in FIG. 4, and showing control and processing for the above-described registration processing (printing position adjustment). As shown in FIG. 13, the controller 60, as its functions, realizes a reference nozzle array selection part 71, an adjustment nozzle array selection part 72, a first print control part 73, a second print control part 74, an adjustment value calculation part 75, an adjustment processing control part 76, and an adjustment processing control part 77.

The reference nozzle array selection part 71 selects a plurality of nozzle arrays used for printing reference patterns. For example, in a case where the print head 301 has a plurality chips arranged therein, nozzle arrays arranged in the same chip are selected for a plurality of nozzle arrays selected as reference nozzle arrays. The adjustment nozzle array selection part 72 selects nozzle arrays for the printing position adjustment. That is, nozzle arrays used for printing a shifted pattern are selected. Note that in the case of performing the printing position adjustment for bidirectional printing, for example, nozzle arrays for the adjustment are selected and used to print a reference pattern in printing and scanning in one of the forward and backward directions. In the print scanning in another direction, the nozzle arrays for the adjustment are used to print a shifted pattern.

The first print control part 73 performs control of processing for printing a plurality of reference patterns on a print medium. The second print control part performs control of processing for printing a first pattern and a second pattern in an overlapping manner by changing a shift amount in the main scanning direction for the plurality of reference patterns printed on the print medium.

The adjustment value calculation part 75 calculates an adjustment value for adjusting the printing position of dots by the adjustment nozzle arrays. More specifically, calculation is made of an adjustment value for adjusting the printing position of dots by the adjustment nozzle arrays with respect to the printing position of dots formed by one of the nozzle arrays used for printing the first pattern based on the reflectivity change in the first pattern and the second pattern printed on the print medium. The adjustment processing control part controls over the processing in connection with the printing position adjustment processing.

The adjustment processing control part 76 controls a printing operation in which an ejection timing of each nozzle is adjusted based on an adjustment value stored in the RAM 54 or the like. Accordingly, a landing position (adhering position) of a dot formed on the print medium is corrected (adjusted).

Figure 14:
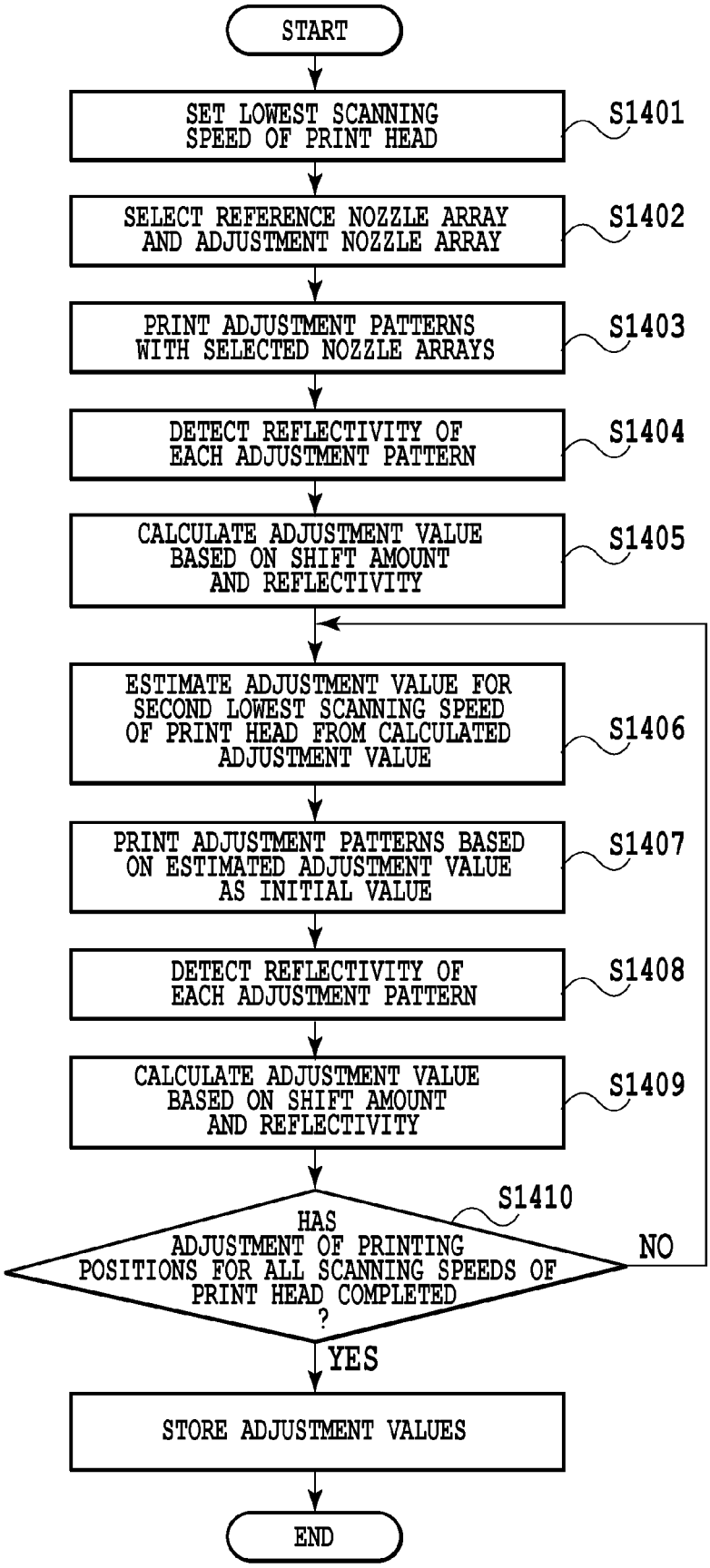
FIG. 14 is a flowchart of processing for obtaining an adjustment value in the printing apparatus according to the first embodiment of the present invention.

FIG. 14 is a flowchart showing processing for obtaining an adjustment value in the printing apparatus according to the present embodiment.

First, the lowest scanning speed among the plurality of scanning speeds of the print head is set (S1401). The printing apparatus according to the present embodiment can set a plurality of print modes for printing at different scanning speeds, and first performs registration for the lowest scanning speed in the printing speeds of the print modes. Then, the reference nozzle array selection part 71 selects nozzle arrays (reference nozzle arrays) serving as a reference and the adjustment nozzle array selection part 72 selects nozzle arrays for the adjustment (S1402). Then, the first print control part 73 prints the reference pattern 601 on the print medium with use of the reference nozzle arrays, whereas the second print control part 74 prints the shifted pattern 602 on the print medium with use of the adjustment nozzle arrays (S1403; pattern printing step).

Next, with use of the optical sensor 500, a density of the adjustment pattern formed on the print medium is read (S1404). The density of the adjustment pattern can be obtained as an optical reflectivity by the optical sensor 500 as shown in FIG. 7. Then, the adjustment value calculation part 75 calculates an approximate curve from the optical reflectivity of the obtained adjustment patterns. The adjustment value calculation part 75 also determines a shift amount for the smallest positional displacement between the reference pattern and the shifted pattern based on the calculated approximate curve. Then, an adjustment value is calculated based on the adjustment value (i.e., an initial value) corresponding to a shift amount when the adjustment pattern is formed and the obtained shift amount (S1405; adjustment value obtaining step). More specifically, an interpolation operation is performed by using an adjustment value corresponding to a shift amount greater than the obtained shift amount by one unit and an adjustment value corresponding to a shift amount smaller than the obtained shift amount by one unit, of the shift amounts when the adjustment patterns are formed, and an adjustment value corresponding to the obtained shift amount is obtained. Note that if the adjustment pattern has a resolution (in the main scanning direction) of 1200 dpi, the adjustment value is calculated by a 1200 dpi unit.

Next, an adjustment value for a second lowest scanning speed is estimated from the calculated adjustment value (S1406). More specifically, as described with reference to FIG. 12, a ratio of the second lowest scanning speed to the lowest scanning speed as set in S1401 is multiplied by the above-calculated adjustment value, so that an adjustment value for the second lowest scanning speed is estimated. Since the scanning speed and the adjustment value are in the linear relationship in the example shown in FIG. 12, estimation is made based on a linear function. It should be noted that an estimation method may be changed based on the relationship between the scanning speed and the adjustment value.

Next, based on the estimated adjustment value as an initial value, the adjustment pattern is formed (S1407; pattern printing step), and a reflectivity of the adjustment pattern printed on the print medium is measured (a density is read) (S1408). Then, in the same manner as the processing in S1405, a shift amount at which the smallest positional displacement can be achieved is obtained based on the measured optical reflectivity, and an adjustment value is calculated based on the adjustment value when the adjustment pattern is formed and the shift amount (S1409; adjustment value obtaining step).

Until adjustment values for all of the different scanning speeds of the print head according to the present embodiment are calculated, the processing from S1406 to S1409 is repeated (S1410). After completing the calculation of the adjustment values for all scanning speeds (S1410), the calculated adjustment value is stored in a storage area of the RAM 54 or the like for each scanning speed, and the present processing is completed.

As described above, according to the first embodiment, the adjustment for a lower scanning speed of the print head is performed first, and then an adjustment value for a higher scanning speed is estimated based on the adjustment value for the lower scanning speed. Based on the estimated adjustment value as an initial value, an adjustment pattern is formed and measured. Accordingly, without extending the shift amount range for a higher speed, an appropriate adjustment value can be calculated. As a result, it is possible to suppress an increase in the number of adjustment patterns, and accordingly adjustment patterns can be reduced while maintaining adjustment accuracy and ink usage or consumption of print media can also be suppressed as possible.

Second Embodiment

The above-described first embodiment relates to a mode in which the present invention is applied to printing position adjustment for two levels of the scanning speed of the print head. A second embodiment of the present invention relates to a mode in which the present invention is applied to printing position adjustment for three or more levels of the scanning speed.

As described with reference to FIG. 12 regarding the first embodiment, in a case where the scanning speed of the print head has two levels of the scanning speed, the adjustment for the lower scanning speed is performed first, and then an adjustment value for a higher scanning speed is estimated based on the obtained adjustment value. The estimated adjustment value is set as an initial value (median value of the shift amount range) for forming the adjustment pattern for a higher scanning speed. On the other hand, in a case where the scanning speed of the print head has three or more levels of the scanning speed, since adjustment values for at least two scanning speeds exist in estimating an adjustment value for the highest scanning speed of the print head, reliability of the estimated adjustment value increases as compared to the case of estimating the adjustment value for a higher scanning speed based on an adjustment value for one scanning speed. In this respect, the present embodiment relates to the printing apparatus having three or more levels of the scanning speed mode of the print head, and in this apparatus, based on an adjustment value for printing position adjustment for at least two scanning speeds, an adjustment value for a higher scanning speed is estimated.

Figure 15:
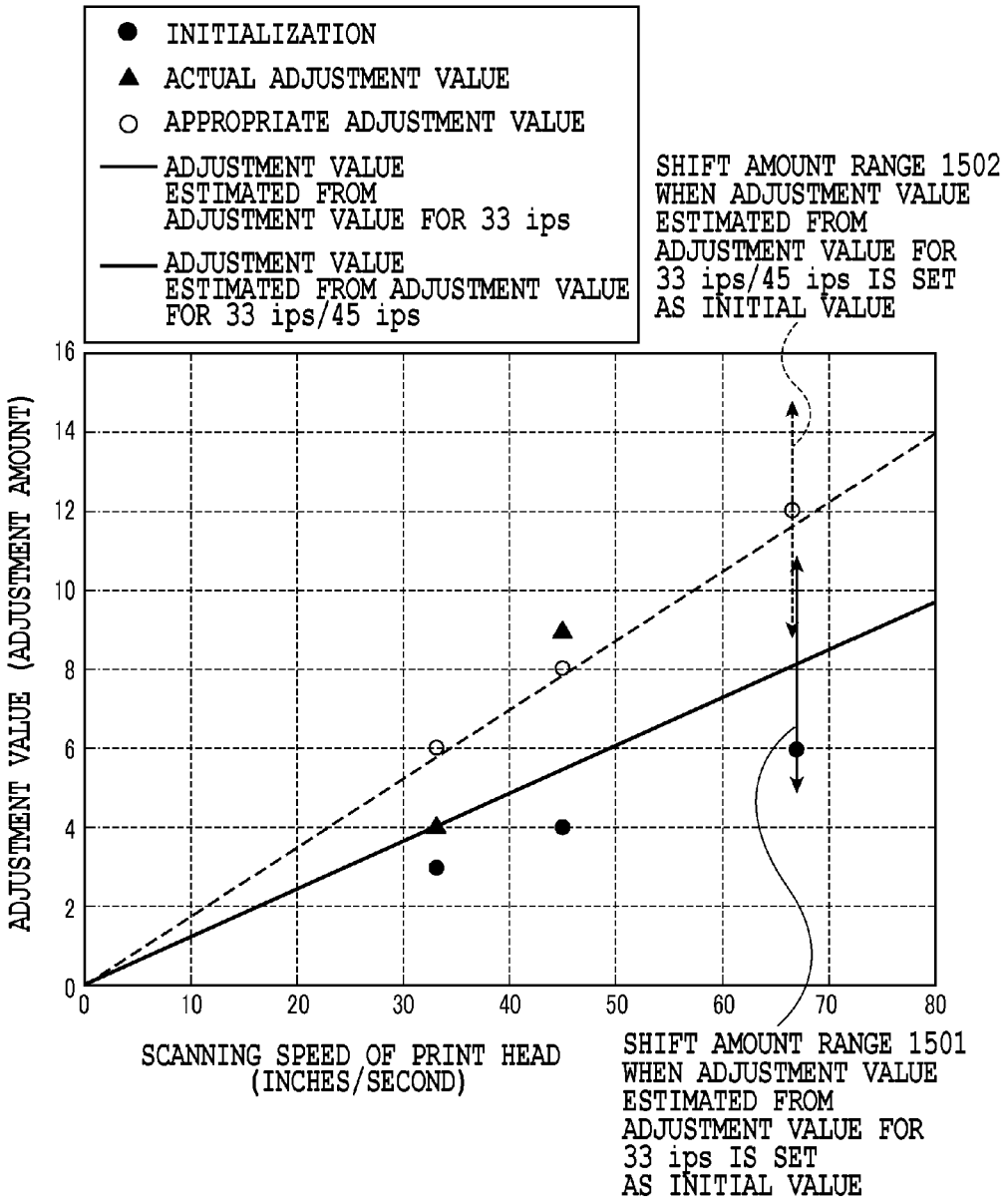
FIG. 15 is a graph illustrating settings of a shift amount range corresponding to adjustment patterns for three different scanning speeds according to a second embodiment of the present invention.

FIG. 15 is a graph illustrating settings of a shift amount range corresponding to adjustment patterns for three different scanning speeds according to the present embodiment. FIG. 15 is a graph similar to FIG. 12 according to the first embodiment. An example shown in FIG. 15 relates to a printing apparatus having print modes for printing at scanning speeds of 33 ips (inches per second), 45 ips, and 67 ips.

For the printing position adjustment for scanning speeds of 33 ips and 45 ips, the same processing may be performed as that shown in FIG. 14 according to the first embodiment, and a description thereof will be omitted. First, a description will be given of the processing for completing the printing position adjustment for scanning speeds of 33 ips and 45 ips, and estimating an initial value for forming an adjustment pattern for a scanning speed of 67 ips. In the printing position adjustment for scanning speeds of 33 ips and 45 ips, a minor shift from an appropriate adjustment value may exist. In FIG. 15, a point on a solid line represents an appropriate adjustment value estimated based on the obtained adjustment value for a scanning speed of 33 ips, whereas a point on a broken line represents an appropriate adjustment value estimated based on both of the adjustment values for scanning speeds of 33 ips and 45 ips.

In this manner, in a case where the adjustment value actually obtained is shifted from the appropriate adjustment value, as shown in FIG. 15, there may be a case where an appropriate adjustment value for a scanning speed of 67 ips does not fall within a shift amount range 1501 depending on the adjustment value for the scanning speed of 33 ips if an adjustment pattern is formed based on the adjustment value estimated only from the adjustment value for the scanning speed of 33 ips as an initial value. In this case, printing position adjustment cannot be appropriately performed without increasing the patterns.

On the other hand, in a case where an appropriate value estimated from the adjustment values for both of the scanning speeds of 33 ips and 45 ips is set as an initial value and an adjustment pattern for a scanning speed of 67 ips is formed, since the appropriate adjustment value is included in the shift amount range 1502, appropriate adjustment can be performed without increasing the number of adjustment patterns. The way of specific estimation based on the adjustment values for both of the scanning speeds of 33 ips and 45 ips is as follows. By using an adjustment value obtained for each of the scanning speeds of 33 ips and 45 ips, an approximate curve for the scanning speed (a broken line in FIG. 15) is created. Then, an adjustment value for a scanning speed of 67 ips satisfying the relationship of the broken line is obtained. In other words, by using the adjustment values for the scanning speeds of 33 ips and 45 ips, linear interpolation for a scanning speed of 67 ips is performed so as to obtain an adjustment value for the scanning speed of 67 ips.

The above-described example relates to the processing for obtaining an adjustment value for one higher scanning speed based on the adjustment values for two scanning speeds. The application of the present invention is not limited to this example. The above-described two scanning speeds are included in two or more (N levels) scanning speeds from K scanning speed to (K+(N−1)) scanning speed (K is a positive integer and N is an integer equal to or greater than 2), and an adjustment value for a first scanning speed to (M−1) scanning speed that are lower than M (M is an integer of 2≤M≤N−1) scanning speed is obtained before forming an adjustment pattern for the M scanning speed, and further based on the adjustment value estimated based on the adjustment value obtained for the first scanning speed to (M−1) scanning speed, an adjustment pattern for the M scanning speed is formed. Based on the optical characteristics of the printed adjustment pattern for the M scanning speed, an adjustment value for the M scanning speed is obtained.

Note that in the printing position adjustment of the present embodiment, adjustment processing is performed in the order of the lowest to highest scanning speed, such as 33 ips, 45 ips, and 67 ips. However, for example, in a case where it is determined that a printing position error in the printing position of dots is small at scanning speeds of 33 ips and 45 ips and adequately falls within the adjustment range, the printing position adjustment may be performed in the order of 45 ips, 33 ips, and 67 ips. As described in the first embodiment, as the scanning speed of the print head increases, a printing position error in the printing position of dots caused by the head-print medium distance and the ink ejection speed increases. Accordingly, based on the relationship between the adjustment range and the scanning speed of the print head, the adjustment at a scanning speed at which a printing position error is not determined to fall within the adjustment range may be performed after the adjustment for a lower scanning speed.

Note that since the functional configurations in the controller 60 according to the second embodiment and the processing of the printing position adjustment are performed in the same manner as shown in FIGS. 13 and 14 according to the first embodiment, a description thereof will be omitted. In the printing position adjustment processing according to the present embodiment, a calculation method of an initial value with respect to a scanning speed in the processing in S1406 of FIG. 14 is different.

As described above, according to the second embodiment of the present invention, when adjustment patterns for scanning speeds are formed, printing is performed with an initial value estimated based on a printing position adjustment value at two or more scanning speeds that are lower than a scanning speed. Accordingly, it is possible to suppress an influence of a variation of the printing position adjustment itself as compared to the case of estimating from the printing position adjustment value at one scanning speed. Thus, it is possible to perform precise printing position adjustment without increasing the number of adjustment patterns.

Other Embodiments

Modes of adjustment patterns are not limited to the modes show in FIGS. 5 and 6, and it is also possible to use patterns that have the highest density in a state in which a printing position is not displaced.

Regarding the adjustment values calculated in the above-described first and second embodiments, it is also possible to determine a default value of an adjustment value in an inspection step at the time of shipment if no updating is required, and store the default value in the ROM 52 or the like. However, in a case where printing position adjustment is performed based on user's instructions or by carrying-in to a serviceperson or a service center, adjustment values are configured to be stored in an EEPROM (not shown) so that they are appropriately updated.

It should be noted that the configuration or the number of nozzle arrays or print heads as described in the first and second embodiments, and further the type or number of ink colors are only exemplary, and they may be appropriately changed. For example, in the above description, the printing apparatus is exemplified by the printing apparatus having four colors of inks, Bk, C, M, and Y, but it is also possible to install, for example, low density color inks, such as light cyan or light magenta, or color inks, such as red or green. The printing apparatus may also have a plurality of print heads mounted therein.

In the first and second embodiments, an inkjet printing apparatus is described as an example, but the printing apparatus is not limited thereto. The printing apparatus may have any configuration as long as it performs printing by moving a print head relative to a print medium (relative movement) to form dots. The present invention may be applied to any printing apparatus irrespective of printing systems.

Further, in the first and second embodiments, as an exemplary method for detecting a displacement between adjustment patters, detection of a density with use of an optical sensor is described, but the detection method is not limited thereto. For example, a user may select an appropriate pattern by a visual check and input the selected pattern to the printing apparatus to obtain an adjustment value.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-210371, filed Oct. 7, 2013 which is hereby incorporated by reference herein in its entirety.

What is claimed is:

1. A printing apparatus for performing printing on a print medium by scanning with a print head in which a first scanning speed of the print head and a second scanning speed that is higher than the first scanning speed are capable of being set, the apparatus comprising:

a pattern forming unit configured to form a plurality of adjustment patterns for each of the first scanning speed and the second scanning speed, the plurality of adjustment patterns each including a first pattern and a second pattern and having a different shift amount corresponding to a difference in a relative printing position between the first pattern and the second pattern; and an adjustment value obtaining unit configured to obtain an adjustment value based on the plurality of adjustment patterns formed for adjusting a printing position, for each of the first scanning speed and the second scanning speed, wherein the adjustment value obtaining unit obtains an adjustment value for the first scanning speed before the pattern forming unit forms adjustment patterns for the second scanning speed; the pattern forming unit forms adjustment patterns by scanning with the print head at the second scanning speed with a shift amount based on the adjustment value obtained for the first scanning speed; and the adjustment value obtaining unit obtains an adjustment value for the second scanning speed based on the adjustment patterns formed by scanning with the print head at the second scanning speed.

2. The printing apparatus according to claim 1, wherein the pattern forming unit determines the shift amount to form the adjustment patterns for the second scanning speed, based on an adjustment value corresponding to the second scanning speed in a linear relationship between the scanning speed and the adjustment value.

3. The printing apparatus according to claim 1, wherein the first scanning speed and the second scanning speed are included in N levels of the scanning speed from K-th scanning speed to (K+(N−1))-th scanning speed (K is a positive integer and N is an integer equal to or greater than 2), and the adjustment value obtaining unit obtains an adjustment value for the K-th scanning speed to (M−1)-th scanning speed that are lower than M-th (M is an integer of $K+1 \leq M \leq N-1$) scanning speed before forming adjustment patterns for the M-th scanning speed; and further the pattern forming unit forms adjustment patterns for the M-th scanning speed with a shift amount based on the adjustment value obtained for the K-th scanning speed to (M−1)-th scanning speed, and the adjustment value obtaining unit obtains an adjustment value for the M-th scanning speed based on the formed adjustment patterns for the M-th scanning speed.

4. The printing apparatus according to claim 3, wherein the pattern forming unit determines the shift amount to form the adjustment patterns for the M-th scanning speed by linear interpolation of the adjustment value for the K-th scanning speed to (M−1)-th scanning speed.

5. The printing apparatus according to claim 1, wherein the first pattern is formed by a forward scan of the print head, and the second pattern is formed by a backward scan of the print head.

6. The printing apparatus according to claim 1, wherein the adjustment value obtaining unit obtains an adjustment value based on information about the adjustment patterns inputted by a user.

7. The printing apparatus according to claim 1, wherein the adjustment value obtaining unit obtains optical characteristics of an adjustment pattern by using an optical sensor.

8. The printing apparatus according to claim 1, further comprising: a determination unit configured to determine a shift amount based on the adjustment value for the first scanning speed, based on the adjustment value for the first scanning speed obtained by the adjustment value obtaining unit, wherein the pattern forming unit forms the plurality of adjustment patterns so that a shift amount of the second pattern from the first pattern varies among the plurality of patterns, based on the shift amount determined by the determination unit, the first pattern set as a reference pattern, and the pattern forming unit forms the first pattern before the determination unit determines the shift amount.

9. The printing apparatus according to claim 1, further comprising: a determination unit configured to determine a shift amount based on the adjustment value for the first scanning speed, based on the adjustment value for the first scanning speed obtained by the adjustment value obtaining unit, wherein the pattern forming unit forms the plurality of adjustment patterns so that a shift amount of the second pattern from the first pattern varies among the plurality of patterns, based on the shift amount determined by the determination unit, the first pattern set as a reference pattern, and the pattern forming unit starts forming the first pattern and starts forming the second pattern after the adjustment value obtaining unit obtains an adjustment value for the first scanning speed.

10. The printing apparatus according to claim 1, wherein the pattern forming unit forms adjustment patterns by scanning with the print head at the second scanning speed with a shift amount based on an adjustment value obtained for the first scanning speed such that the shift amount of the adjustment pattern corresponding to the obtained adjustment value for the second scanning speed corresponds to a median value of the different shift amounts of the plurality of adjustment patterns for the second scanning speed.

11. A method for adjusting a printing position in a printing apparatus for performing printing on a print medium by scanning with a print head in which a first scanning speed of the print head and a second scanning speed that is higher than the first scanning speed are capable of being set, the method comprising:

a pattern forming step of forming a plurality of adjustment patterns for each of the first scanning speed and the second scanning speed, the plurality of adjustment patterns each including a first pattern and a second pattern and having a different shift amount corresponding to a difference in a relative printing position between the first pattern and the second pattern; and an adjustment value obtaining step of obtaining an adjustment value based on the plurality of adjustment patterns formed for adjusting a printing position, for each of the first scanning speed and the second scanning speed, wherein the adjustment value obtaining step obtains an adjustment value for the first scanning speed before the pattern forming step forms adjustment patterns for the second scanning speed; the pattern forming step forms adjustment patterns by scanning with the print head at the second scanning speed with a shift amount based on the adjustment value obtained for the first scanning speed; and the adjustment value obtaining step obtains an adjustment value for the second scanning speed based on the adjustment patterns formed by scanning with the print head at the second scanning speed.

12. A method for adjusting a printing position in a printing apparatus for performing printing on a print medium by scanning with a print head in which a plurality of different scanning speeds are capable of being set, the method comprising:

a first pattern forming step of forming at least one adjustment pattern group by scanning with the print head, the at least one adjustment pattern group consisting of a plurality of adjustment patterns, the plurality of adjustment patterns each including a first pattern and a second pattern and having a different shift amount corresponding to a difference in a relative printing position between the first pattern and the second pattern;

a second pattern forming step of forming, after forming the at least one adjustment pattern group, an adjustment pattern group having the same shift amount range as that of the at least one adjustment pattern group at a scanning speed that is higher than that when the at least one adjustment pattern group is formed; and an adjustment value obtaining step of obtaining an adjustment value for the scanning speed that is higher than that when the at least one adjustment pattern group is formed, based on the adjustment pattern group formed in the second pattern forming step.

13. A printing apparatus for performing printing on a print medium by scanning with a print head in which a first scanning speed of the print head and a second scanning speed that is higher than the first scanning speed are capable of being set, the apparatus comprising:

a pattern forming unit configured to form a plurality of adjustment patterns for each of the first scanning speed and the second scanning speed, the plurality of adjustment patterns each including a first pattern and a second pattern and having a different shift amount which is a difference in a relative printing position between the first pattern and the second pattern;

a reading unit configured to read the plurality of adjustment patterns;

an adjustment value obtaining unit configured to obtain an adjustment value based on a reading result of the plurality of adjustment patterns formed for adjusting a printing position, for each of the first scanning speed and the second scanning speed, wherein the reading unit reads the plurality of adjustment patterns for the first scanning speed before the pattern forming unit forms adjustment patterns for the second scanning speed; the pattern forming unit forms adjustment patterns by scanning with the print head at the second scanning speed with a shift amount based on the reading result of the plurality of adjustment patterns for the first scanning speed.

* * * * *